US010435935B2

(12) United States Patent
Zimmer et al.

(10) Patent No.: US 10,435,935 B2
(45) Date of Patent: Oct. 8, 2019

(54) DAMPER ASSEMBLY OF A CUP HINGE

(71) Applicants: Martin Zimmer, Rheinau (DE); Guenther Zimmer, Rheinau (DE)

(72) Inventors: Martin Zimmer, Rheinau (DE); Guenther Zimmer, Rheinau (DE)

( * ) Notice: Subject to any disclaimer, the term of this patent is extended or adjusted under 35 U.S.C. 154(b) by 0 days.

(21) Appl. No.: 15/986,125

(22) Filed: May 22, 2018

(65) Prior Publication Data

US 2018/0328093 A1 Nov. 15, 2018

Related U.S. Application Data

(63) Continuation-in-part of application No. PCT/DE2016/000421, filed on Nov. 25, 2016.

(30) Foreign Application Priority Data

Nov. 26, 2015 (DE) ..... 10 2015 015 168

(51) Int. Cl.
*E05F 1/08* (2006.01)
*E05F 5/00* (2017.01)
*E05F 5/02* (2006.01)

(52) U.S. Cl.
CPC ..... *E05F 5/006* (2013.01); *E05F 5/02* (2013.01); *E05Y 2201/21* (2013.01);
(Continued)

(58) Field of Classification Search
CPC ..... E05Y 2900/20; E05Y 2900/202; E05Y 2900/204; E05Y 2900/208; E05Y 2201/20;
(Continued)

(56) References Cited

U.S. PATENT DOCUMENTS 8,505,165 B2 8/2013 Domenig et al.
8,650,711 B1 * 2/2014 Chen ..... E05F 5/006 16/286
(Continued)

FOREIGN PATENT DOCUMENTS

AT 509 720 B1 11/2011
DE 20 2010 015 536 U1 4/2012
(Continued)

OTHER PUBLICATIONS

English translation of the "International Search Report" for the corresponding international application No. PCT/DE2016/000421; dated Feb. 10, 2017; 2 pages.

*Primary Examiner* — Chuck Y Mah
(74) *Attorney, Agent, or Firm* — Ronald S. Lombard

(57) ABSTRACT

The invention concerns a damper assembly for a cup hinge having a carrier part and a cylinder-piston unit which comprises a cylinder that is axially displaceable relative to the carrier part and can be reset by means of spring elements, and a piston rod guided in the cylinder and also a cup hinge with such a damper assembly. The carrier element includes an integrated, elastically deformable accommodation web to which the piston rod can be fixed. Furthermore, the carrier element has, at its side opposite the accommodation web, two elastically deformable fixing elements which are arranged spaced from each other, With the present invention, a damper assembly is being developed which can be installed safely and exchangeably into a cup hinge with a small force application and also a cup hinge with such a damper assembly.

6 Claims, 3 Drawing Sheets

(52) U.S. Cl.
CPC ... *E05Y 2201/214* (2013.01); *E05Y 2201/256* (2013.01); *E05Y 2201/264* (2013.01); *E05Y 2600/53* (2013.01); *E05Y 2900/20* (2013.01)

(58) Field of Classification Search
CPC ..... E05Y 2201/21; E05Y 2201/256; E05F 5/006; E05F 5/02; E05D 11/1021; E05D 11/1042; E05D 11/105; E05D 11/1064; E05D 7/04; E05D 7/0407; E05D 7/125; E05D 3/142; Y10T 16/5383; Y10T 16/304; Y10T 16/54029
See application file for complete search history.

(56) References Cited

U.S. PATENT DOCUMENTS

2003/0200625 A1* 10/2003 Zimmer ..... E05F 5/006 16/306
2005/0015927 A1* 1/2005 Kropf ..... E05D 3/142 16/286
2012/0126677 A1* 5/2012 Ahlfeld ..... E05F 5/006 312/326
2013/0000075 A1* 1/2013 Forster ..... E05F 5/006 16/84
2013/0145580 A1* 6/2013 Brunnmayr ..... E05F 5/006 16/277
2013/0160242 A1* 6/2013 Brunnmayr ..... E05F 5/006 16/286
2014/0345081 A1* 11/2014 Salice ..... E05F 5/006 16/50
2014/0352111 A1* 12/2014 Ng ..... E05F 5/02 16/286
2014/0366322 A1* 12/2014 Salice ..... E05F 5/006 16/277

FOREIGN PATENT DOCUMENTS

DE 10 2011 103 894 A1 12/2012
DE 20 2012 003 508 U1 8/2013
WO WO 2014/000931 A1 1/2014

* cited by examiner

DAMPER ASSEMBLY OF A CUP HINGE

CROSS-REFERENCE TO RELATED APPLICATIONS

This a continuation-in-part application of pending international application PCT/DE2016/000421 filed Nov. 25, 2016, and claiming the priority of German application No. 10 2015 015 168.1 filed Nov. 26, 2015. The said International application PCT/DE2016/000421 and said German application No. 10 2015 015 168.1 are incorporated herein by reference in their entireties as though fully set forth.

BACKGROUND OF THE INVENTION

The invention concerns a damper assembly for a cup hinge with a carrier part and a cylinder-piston unit which comprises a piston rod which is axially movable relative to the carrier part and an axially movable cylinder which is retractable by means of a spring element as well as a piston rod guided in the cylinder and a cup hinge with such a damper assembly.

U.S. Pat. No. 8,505,165 B2 and DE 20 2012 003 508 U1 disclose such damper assemblies. The assembly of such a damper assembly requires high assembly forces. There is also the danger that the components installed are permanently deformed.

AT 509 720 B1 discloses a device wherein the piston rod can be fixed in a spring sheet. The device can be fixed in the hinge cup by means of two engagement projections arranged on the sides of the device.

It is the object of the present invention to provide a damper assembly which can be securely and removably installed in a cup hinge with low force application, and also a cup hinge with such a damper assembly.

SUMMARY OF THE INVENTION

This object is solved with the features of the main claim. To this end, the carrier element has an integral deformable accommodation web in which the piston rod can be fixed. In addition, the carrier element is provided, at its side opposite the accommodation web, with two elastically deformable fixing elements which are arranged in spaced relationship.

In the cup hinge including the damper assembly, the damper assembly is fixed in the hinge cup of the cup hinge by the fixing elements and by the piston rod head in a force- and/or form-locking manner.

BRIEF DESCRIPTION OF THE DRAWINGS

Further particulars of the invention will become apparent from the claims and the following description of schematically represented embodiments.

DETAILED DESCRIPTION OF THE INVENTION

Figure 1:
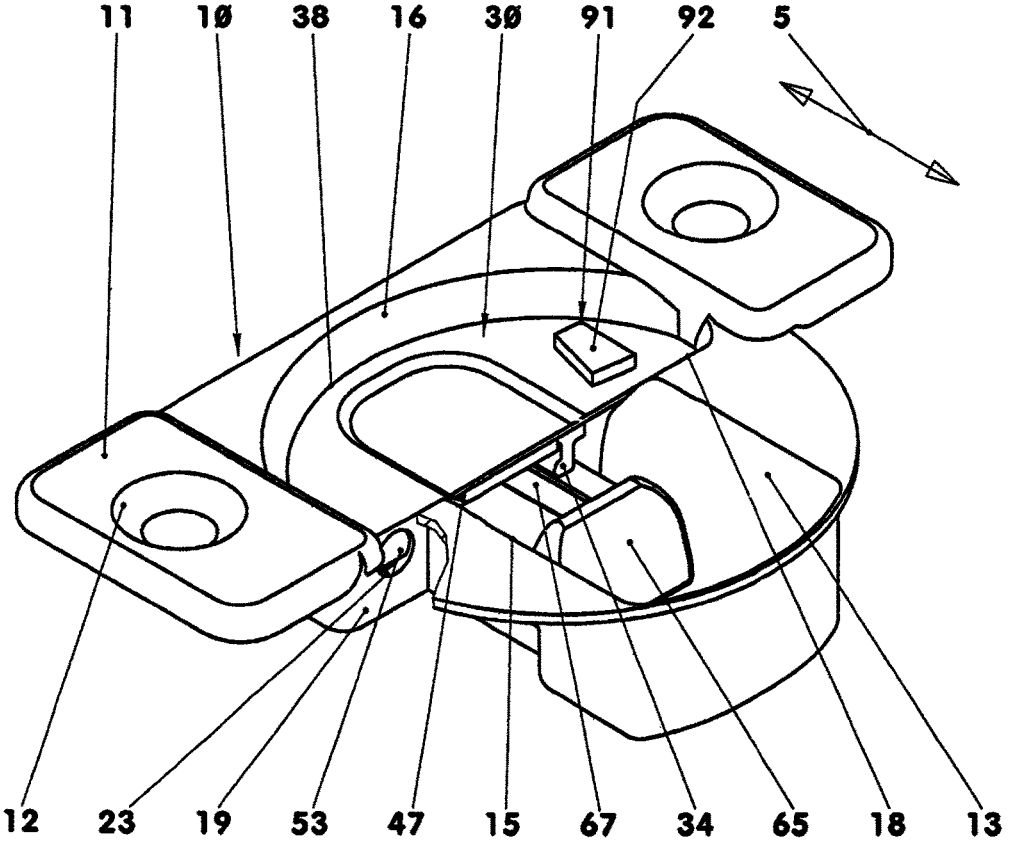
FIG. 1: A hinge cup with damper assembly.
Figure 2:
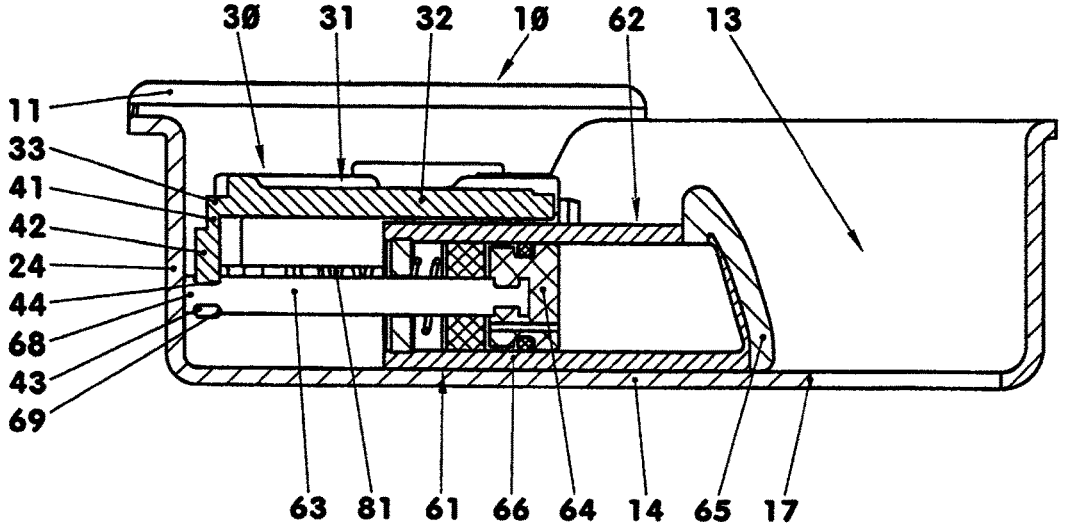
FIG. 2: A longitudinal cross-sectional view of FIG. 1.

FIGS. 1 and 2 shows the hinge cup 10 of a cup hinge with a damper assembly 30 disposed therein. A cup hinge includes generally a mounting arm which is pivotable relative to the hinge cup 10 and via which the hinge cup 10 is connected via one or two pivot levers. Depending on conditions, the mounting arm may also be arranged directly on the hinge cup 10. The hinge cup 10 and the mounting arm are attached to furniture parts which are movable relative to each other, for example, a furniture door and a furniture body. During closing of the door, the mounting arm and/or the pivot lever moves into the hinge cup 10. Hereby the damper assembly 30 is actuated whereby the closing movement is slowed down so that the door is closed smoothly.

The hinge cup 10 is provided in the exemplary embodiment with an attachment flange 11 provided with two outer through-bores 12 for accommodating mounting elements such as mounting screws. Between the through-bores 12, the hinge cup 10 has a recess 13 which, in a top view, is for example mushroom shaped. Its depth is for example one fourth of the distance between the two through bores 12. The bottom 14 of the recess 13 may also be provided with steps. The recess 13 comprises a longitudinal section 15 and an adjacent circular segment-shaped section 16. The longitudinal section 15 is oriented in the longitudinal direction 5 of the hinge cup 10 and has at its bottom 14 a hinge opening 17. The base 18 of the circular segment-shaped section 16 is normal to the longitudinal direction 5 of the cup hinge and points in the direction of the mounting arm. The base 18 is formed by a two-part front wall 19 which, at both sides, butts against the longitudinal section 15. In the exemplary embodiment, each of the front wall parts is provided with for example a circular opening 23. However the openings 23 on the front wall 19 may also be omitted. The wall 24 of the hinge cup 10 which delimits the circular segment-shaped section 16 and which is oriented normal to the bottom 14 is in the form of a cylinder barrel surface. This wall 24 may also be provided with openings. The hinge cup 10 is for example shaped so as to be axis-symmetric with respect to vertical longitudinal center plane of the hinge cup. The longitudinal center plane is oriented in the longitudinal direction 5 of the hinge cup.

FIG. 2 shows the hinge cup 10 with a damper assembly 30 installed therein in a longitudinal cross-sectional view. The damper assembly 30 is disposed in the recess 13 and is fixed on the walls 19, 24 of the hinge cup 10 spaced from the bottom 14. The distance from the bottom is for example only a few tenths of a millimeter. The damper assembly 30 comprises a carrier part 31 which accommodates a cylinder-piston unit 61. The for example hydraulic cylinder-piston unit 61 comprises a cylinder 62 and a piston rod 63 with a piston 64 guided in the cylinder 62. In the exemplary embodiment, the piston rod 63 is stationary with respect to the hinge cup 10. The cylinder 62 is movable relative to the piston rod 62 in the longitudinal direction 5 of the hinge cup 10. As shown in FIG. 2, the cylinder 62 projects with the cylinder bottom 65 into the longitudinal section 15 of the recess 13. The cylinder bottom may for example by arched uniaxially wherein the radial center point is disposed in the area of the cylinder wall 66 adjacent the hinge cup bottom 14.

Figure 3:
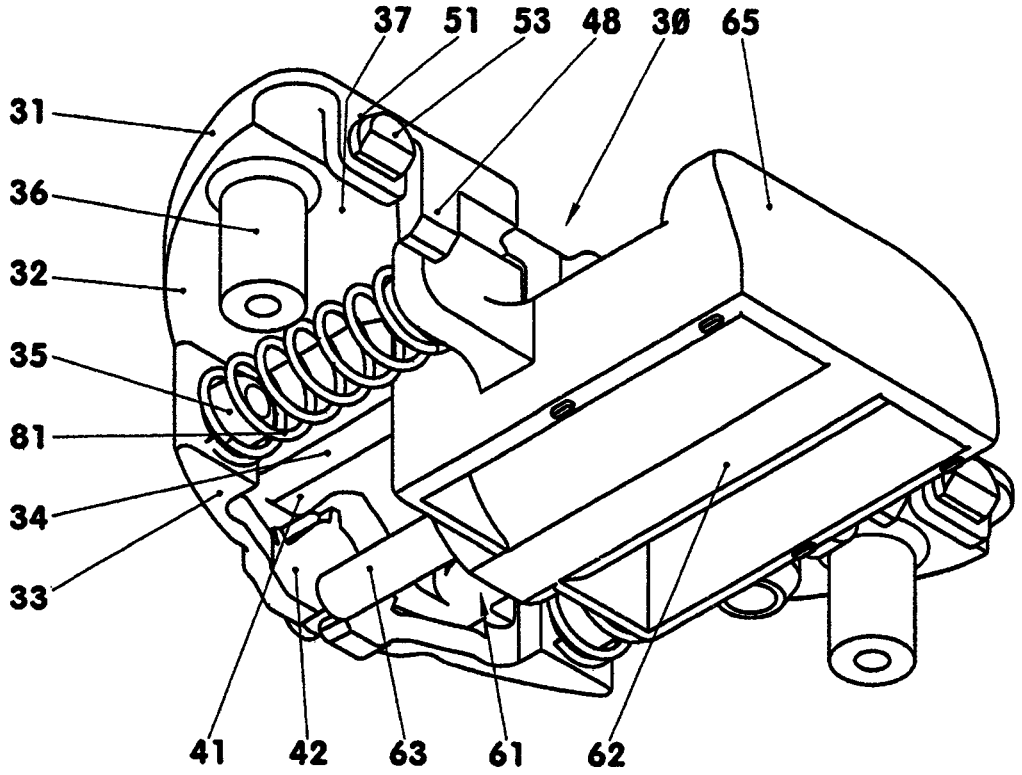
FIG. 3: An isometric view of the damper assembly.
Figure 4:
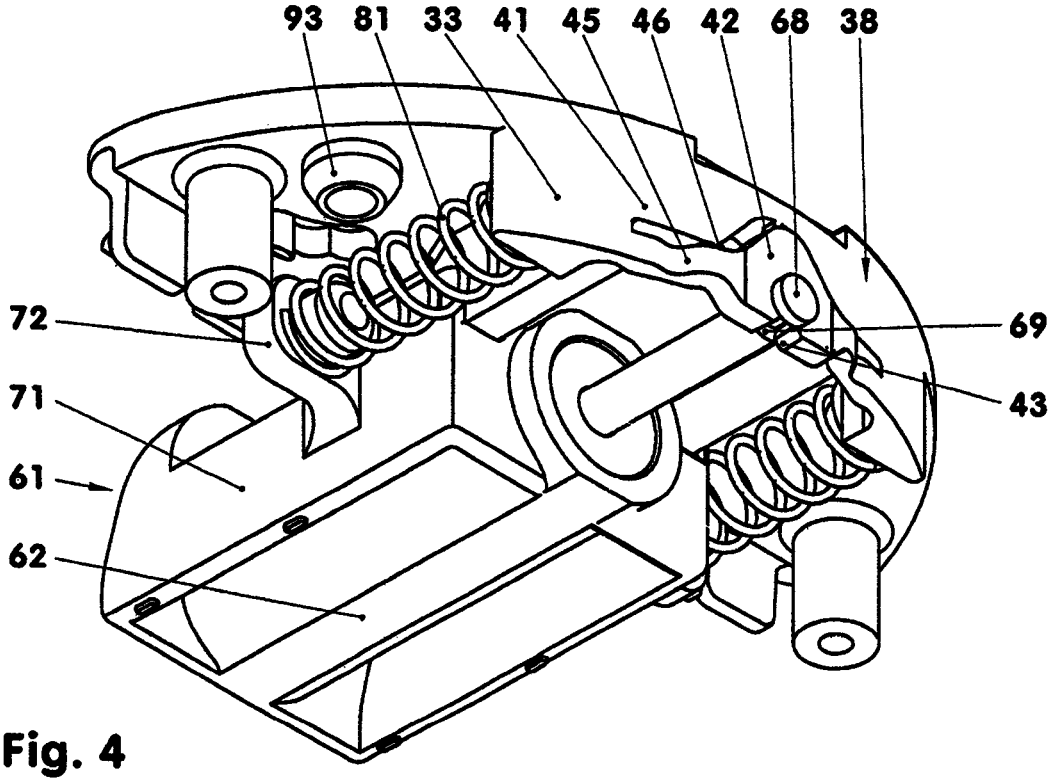
FIG. 4: An isometric view of the damper assembly as seen from the piston rod side.
Figure 5:
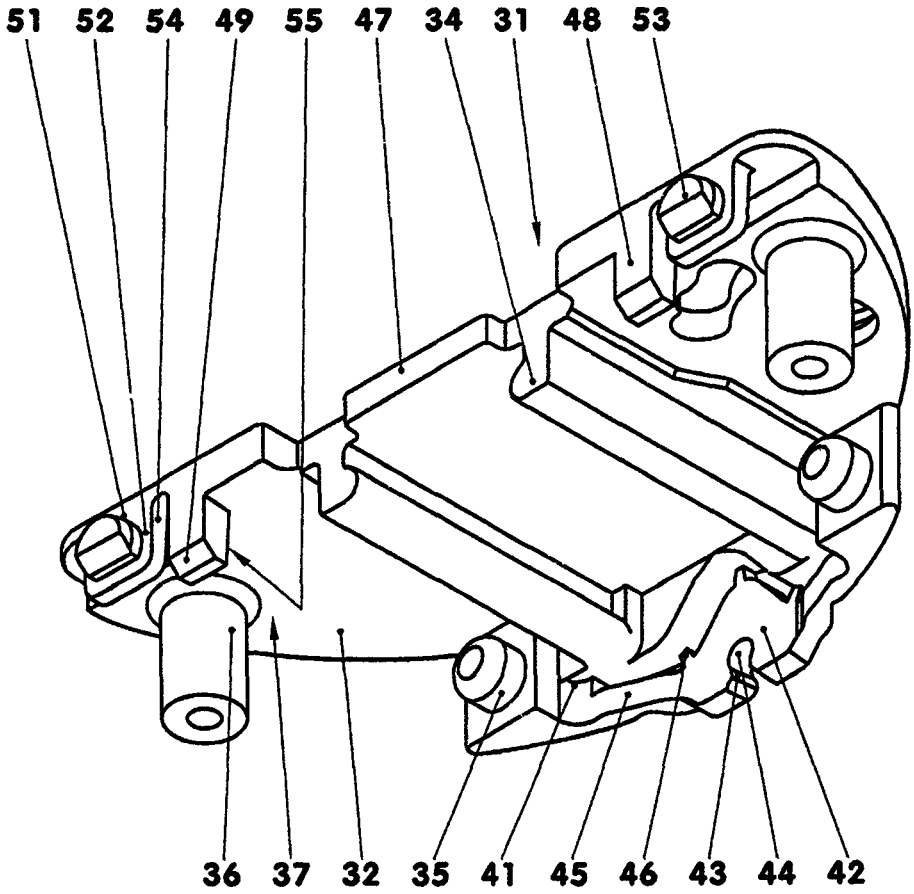
FIG. 5: A carrier element.
Figure 6:
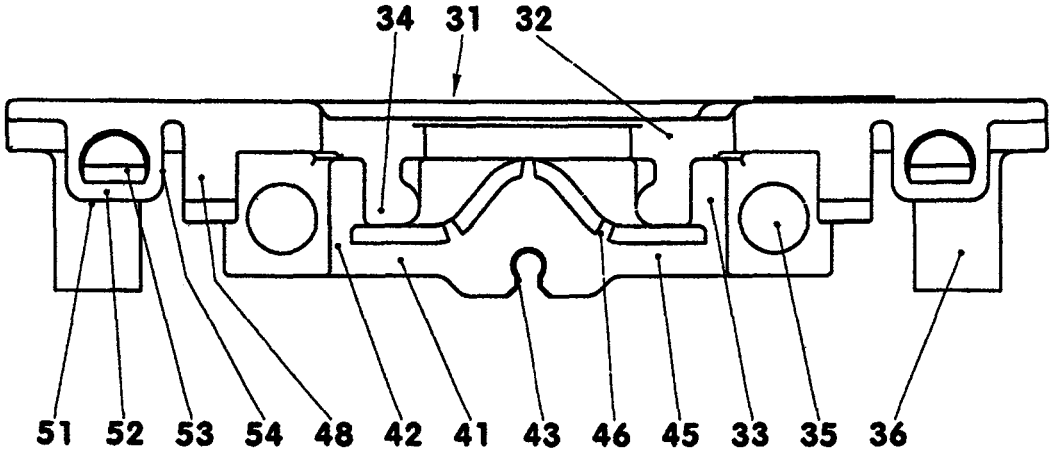
FIG. 6: Front view of the carrier element.

FIGS. 3 and 4 show the damper assembly in an isometric view from below. FIGS. 5 and 6 show the carrier part 31.

The carrier part 31 comprises a carrier plate 32 a carrier rim 33, a cylinder guide flange 34, spring accommodation lugs 35 and support pins 36. In the exemplary embodiment, the carrier part 31 is an injection molded component of a thermoplastic material. The carrier plate 32 is for example in the shape of a circle-segment arranged for example coaxially with the circular segment-shaped section 16 of the hinge cup 10. At its bottom side 37, the carrier plate 32 is provided with two parallel guide webs 34 which form the cylinder guide structure. At opposite sides of the guide flange 34, there are two support pins 36 projecting from the bottom side 37 of the carrier plate 32. They extend from the carrier plate 32 in a direction normal thereto.

In the apex area 38 of the carrier part 31, the carrier part 31 is provided with a carrier rim 33 which extends from the carrier plate 32 in axial symmetry with regard to the vertical longitudinal center plane of the damper assembly 30. The vertical longitudinal center plane of the damper assembly 30 when installed coincides with the vertical longitudinal center plane of the cup hinge. In the outer areas of the carrier part rim 33 which extends normal to the bottom side 37 of the carrier plate 32, there are inwardly projecting spring accommodation lugs 35 arranged. With the damper assembly 30 installed in the hinge cup 10, both spring accommodation lugs 35 are oriented in a direction parallel to the longitudinal direction 5.

The carrier rim 33 comprises a base web 41 connected to the carrier plate 32 and an engagement web 42, which is oriented almost parallel to the base web 41. The arch of the accommodation web 42 extends in the exemplary embodiment over a sector with an opening angle of 33 degrees. The accommodation web 42 is connected at both sides to the base web 41 by means of connecting sections 45. The connecting sections 45 are elastically deformable. Furthermore, in the exemplary embodiment three rupture webs 46 are arranged between the accommodation web 42 and the base web 41 in the central area which, in the representations of the FIGS. 3 to 6, connect the accommodation web 42 to the base web 41. The accommodation web 42 is therefore connected to the base web 41 at several points.

In the representation of FIG. 4, the accommodation web 42 extends outwardly beyond the base web 41, so that, in a top view of the non-loaded damper assembly 30, it projects beyond the container of the carrier plate 32. The thickness of the accommodation web 42 is for example 90% of the thickness of the base web 41. The accommodation web is provided with a piston rod accommodation recess 43. The piston rod accommodation recess 43 has a conical base 44 whose imaginary tip away from the carrier part 31 is disposed outside the accommodation web 42.

At the carrier part base 47 remote from the apex area 38, two guide lugs 48 and two fixing elements 51 are provided symmetrically with respect to the vertical longitudinal center plane. In each case, the guide lug 48 is spaced from the fixing element 51 by a gap 54.

The guide lugs 48 extend normal to the carrier plate 32. They are in this direction longer than the fixing elements 51. At their front end, they are provided with an insert ramp 49 which extends from the apex area 38.

The fixing elements 51 which are arranged outside the guide lugs 48 each include a fixing element disc 52 and a fixing element lug 53 which may be arranged centrally on the fixing element disc 52. But the individual fixing element disc 52 may also be provided without fixing element lug 53. In the exemplary embodiment, the fixing element discs 52 are in alignment with a vertical plane which extends normal to the vertical longitudinal center plane and in which also the guide lugs 48 extend. However, they may also project out of this plane in a direction opposite the apex area 38. The fixing element discs are elastically deformable. The semi-cylindrical fixing element lugs 53 project from the mentioned plane which extends normal to the vertical longitudinal center plane in a direction opposite the apex area 38. The outer diameter of the individual fixing element lug 53 is slightly less than the diameter of the individual opening 23 of the hinge cup 10.

The cylinder 62 of the cylinder-piston unit 61 includes an upper guide web 67 for insertion into the cylinder guide flanges 34. The piston rod 63 projecting from the cylinder 62 is provided at the piston rod head 68 with an annular groove 69. By means of this annular groove 69, the piston rod 63 is fixed in the piston rod receiving recess 43 of the accommodation web 42 as shown in FIGS. 2-4. The piston rod head 68 projects from the accommodation web 42.

The cylinder 62 is further provided with peg-like spring support members 72 which project from the side surfaces 71 thereof. These spring support members 72 are arranged in alignment with the spring accommodation lugs 35 of the carrier part 31. Between a carrier element side spring accommodation lug 35 and a cylinder side spring support member 72 in each case a compression spring 81 is arranged. The two compression springs 81 which are arranged parallel to each other bias the cylinder 62 into the extended position.

In the exemplary embodiment, a stroke-limiting structure 91 is provided. It comprises a lever 92, for example a pivot lever and a blocking pin 93. With this structure 91, the stroke of the cylinder-piston unit 61 can be limited to a partial stroke of the full stroke. This stroke limiting structure 91 is utilized for example in connection with doors of a small mass. Furthermore, the cylinder-piston unit 61 can be arrested by means of the blocking pin 93 in an extended position of the cylinder 62 with the compression springs 81 relaxed. The damper assembly 30 may also be provided without any stroke limiting structure 91.

During assembly of the damper assembly 30, the cylinder-piston unit 61 is pushed into the cylinder guide flange 34 of the carrier part 31 and is locked behind a locking structure 55. This locking structure 55 is formed for example by the guide lugs 48. The for example extended piston rod 63 is so engaged with the accommodation web 42 that the annular groove 69 is locked with the piston rod accommodation recess 43. Herein, the rupture webs 46 support the accommodation web, so that it does not bend. When the compression springs 81 are installed and, if applicable, the stroke limiting structure 91 is mounted the damper assembly 30 is completed.

During the insertion of the damper assembly 30 into the hinge cup 10 of the open cup hinge, the damper assembly can be blocked by means of the stroke limiting structure 91. In the exemplary embodiment, the damper assembly 30 is placed onto the hinge pot 10 at an angle so that the piston rod head 68 extends into the hinge cup 10 and the guide lugs 48 are first outside the hinge cup 10. Then the carrier part 31 is pressed with a slight force into the hinge cup 10. During this process, the accommodation web 42 is deformed. The rupture webs 46 may be ripped. The piston rod 63 which extends through the piston rod accommodation web 42 abuts with its piston rod head 68 the wall 24 of the hinge cup 10. When the carrier part 31 is now pressed down the guide lugs 48 move into the hinge cup 10. They guide the damper assembly 30 during further insertion until the fixing elements 51 are accommodated in the hinge cup 10. The installation is completed when either the support pins 36 abut the stepped bottom 14 of the hinge cup 10 or the fixing element lugs 53 are locked in the openings 23 of the hinge cup 10. The hinge cup 10 may be provided with an additional structure for screwing the damper assembly 30 in the hinge cup 10. The activated stroke limiting structure 91 can now be deactivated. If the door has a relatively low mass, the stroke of the cylinder piston unit 61 can be limited by the stroke limiting structure 91.

The fixing elements 51 and the piston rod head 68 form now the corners of an isosceles equal-sided triangle, with two sides of equal length, which interconnects the three contact points of the damper assembly 30 in the hinge cup 10. In the exemplary embodiment, this triangle extends with respect to the plane of the carrier plate 32 at an angle of 12°, wherein the plane of the triangle is inclined in the direction of the piston rod head 68. After insertion in the shown hinge cup 10, the damper assembly 30 is fixed in a force- and form-locking manner. Upon insertion into a hinge cup 10 without openings 23, the elastically deformable fixing elements and the piston rod 63 form a force-locking 3-point engagement of the damper assembly 30 with the hinge cup 10. In both cases, the damper assembly 30 can compensate for tolerances of the hinge cup 10 and bridge any play between the components.

The damper assembly 30 can also be retro-fitted to an existing hinge cup. With the insertion of the force-locking variant, the hinge cup 10 does not require any special preparation. Such retrofitting can also be employed in connection with hinges which are already installed.

After installation of the hinge cup with the damper assembly 30 into a furniture piece, the compression springs 81 press the cylinder 62 relative to the piston rod 63 into the extended position. Upon closing of for example the door, for example the mounting arm comes into contact with the cylinder bottom 65. When the mounting arm contacts the cylinder bottom 65, the force vector generated thereby is for example in the plane of the triangle of the fixing elements 51 and the piston rod head 68 or in a plane parallel thereto. The cylinder 62 is moved against the force of the compression springs 81 relative to the piston rod 63. In this step, the cylinder guide web 67 slides along the cylinder guide flange 34 of the carrier plate 32. The oil displaced within the cylinder 62 decelerates the closing movement of the door. The forces are transferred via the piston rod 63 of the cylinder piston unit 61 directly to the hinge cup 10.

In order to remove the damper assembly 30 from the hinge cup 10, for example a force is applied to the carrier plate 32 in the direction of the apex area 38. The front fixing elements 51 are released from the front wall 19. Now the carrier plate 32 can be lifted at the front and pivoted outwardly. In this procedure the hinge cup 10 remains free of any plastic deformation.

The hinge can then be operated without damper assembly 30 or a new damper assembly 30 can. be inserted. The installation of a new damper assembly 30 is performed as described above. For the removal and the installation, only little force applications are required.

Also, combinations of the various exemplary embodiments are possible.

LISTING OF REFERENCE NUMERALS

| | |
|---|---|
| 5 | Longitudinal direction |
| 10 | Hinge cup |
| 11 | Attachment flange |
| 12 | Through bores |
| 13 | Recess |
| 14 | Bottom |
| 15 | Longitudinal section |
| 16 | Circular segment-shaped section |

-continued

| | |
|---|---|
| 17 | Hinge opening |
| 18 | Base |
| 19 | Front wall |
| 23 | Opening |
| 24 | Wall |
| 30 | Damper assembly |
| 31 | Carrier part |
| 32 | Carrier plate |
| 33 | Carrier part rim |
| 34 | Cylinder guide flange |
| 35 | Spring accommodation lugs |
| 36 | Support pin |
| 37 | Bottom side of carrier plate |
| 38 | Apex area |
| 41 | Base web |
| 42 | Accommodation web |
| 43 | Piston rod accommodation recess |
| 44 | Base of piston rod receiving groove |
| 45 | Connecting sections |
| 46 | Rupture webs |
| 47 | Carrier part base |
| 48 | Guide legs |
| 49 | Insert ramp |
| 51 | Fixing elements |
| 52 | Fixing element disc |
| 53 | Fixing element leg |
| 54 | Gap |
| 55 | Locking structure |
| 61 | Cylinder-piston unit |
| 62 | Cylinder |
| 63 | Piston rod |
| 64 | Piston |
| 65 | Cylinder bottom |
| 66 | Cylinder wall |
| 67 | Guide web |
| 68 | Piston rod head |
| 69 | Annular groove |
| 71 | Side surfaces |
| 72 | Peg-like spring support member |
| 81 | Compression spring |
| 91 | Stroke limiting structure |
| 92 | Pivot lever |
| 93 | Blocking pin |

The invention claimed is:

1. A damper assembly (30) for a cup hinge with a carrier part (31) and a cylinder-piston unit (61) which comprises a cylinder (62) which is axially movable relative to the carrier part (31) and returnable by spring elements (81) and a piston rod (63) guided in the cylinder (62), characterized in that the carrier part (31) includes integrated therewith an elastically deformable accommodation web (42) to which the piston rod (63) can be fixed, the elastically deformable accommodation web (42) extends outwardly beyond a base web (41), wherein the base web (41) is connected to a carrier plate (32), so that in a top view of the non-loaded damper assembly (30), the elastically deformable accommodation web (42) projects beyond the carrier plate (32) and that a piston rod head (68) of the piston rod (63) projects from the elastically deformable accommodation web (42), and the carrier part (31) is provided at its side opposite the accommodation web (42) with two spaced elastically deformable fixing elements (51) arranged in spaced relationship.

2. The damper assembly (30) according to claim 1, characterized in that the two spaced elastically deformable fixing elements (51) and the piston rod head (68) of the piston rod (63) form corners of an isosceles equal-sided triangle with two equal sides, with the two spaced elastically deformable fixing elements (51) provided symmetrically with respect to a vertical longitudinal center plane of the damper assembly (30).

3. The damper assembly (30) according to claim 2, characterized in that the damper assembly (30) is fixed in a hinge cup (10) of the cup hinge by the fixing elements (51) and the piston rod head (68) in a force- and form-locking manner.

4. The damper assembly (30) according to claim 1, characterized in that, in a top view of the carrier part (31), the piston rod (63) projects over the contour of the carrier part (31).

5. The damper assembly (30) according to claim 1, characterized in that rupture webs (46) are provided by which at least the accommodation web (42) in an undeformed state is connected to the base web (41).

6. The damper assembly (30) according to claim 5, characterized in that the rupture webs (46) of the accommodation web (42) in a deformed state are severed.

* * * * *